US005874698A

United States Patent [19]

Collis

[11] Patent Number: 5,874,698

[45] Date of Patent: Feb. 23, 1999

[54] MECHANICAL INTERLOCK ASSEMBLY

[75] Inventor: Todd M. Collis, Schaumburg, Ill.

[73] Assignee: Reltec Corporation, Mayfield Heights, Ohio

[21] Appl. No.: 907,700

[22] Filed: Aug. 8, 1997

[51] Int. Cl.[6] ..... H01H 9/20; H01H 9/28

[52] U.S. Cl. ..... 200/50.33; 200/50.32; 200/43.16

[58] Field of Search ..... 200/DIG. 6, 50.32, 200/50.33, 50.35, 50.37, 43.11, 43.16

[56] References Cited

U.S. PATENT DOCUMENTS

| | | | |
|---|---|---|---|
| 2,259,298 | 10/1941 | De Loache | 200/50 |
| 4,385,214 | 5/1983 | Sullivan | 200/50 C |
| 4,924,041 | 5/1990 | Yee | 200/50 C |

*Primary Examiner*—Wynn Wood Coggins
*Assistant Examiner*—Michael J. Hayes
*Attorney, Agent, or Firm*—Trexler, Bushnell, Giangiorgi & Blackstone, Ltd.

[57] ABSTRACT

Disclosed is a mechanical interlock assembly for use within an electronics enclosure for preventing actuation of a service breaker switch when a main breaker switch is actuated. The mechanical interlock assembly comprises a bracket, an arm and a spring. The arm and spring are retained in a bracket which is mountable within the electronics enclosure adjacent the service breaker switch and the main breaker switch to selectively prevent unwanted actuation of the switches. The arm is slidable along a pin which extends between a first and a second side wall of the bracket. The spring is retained along the pin between the arm and the first side wall of the bracket, and the spring loads a force between the arm and the first side wall of the bracket when the arm is displaced along the pin. The spring presses the arm against a toggle lever of the service breaker switch after the arm has been been displaced and the toggle lever of the service breaker switch has been actuated. The arm supporting panel of the bracket prevents the arm from rotating about the pin.

14 Claims, 7 Drawing Sheets

MECHANICAL INTERLOCK ASSEMBLY

BACKGROUND

This invention is generally directed to a device for preventing unwanted actuation of a switch, and is more specifically directed to a mechanical interlock assembly for use within an electronics enclosure for preventing the actuation of a service breaker switch when a main breaker switch is actuated.

Many equipment enclosures, such as those enclosing wires relating to telephone service, are located outdoors. These outdoor equipment enclosures are necessarily subject to environmental elements such as rain, snow, wind and heat from the sun. Therefore, it is imperative that these outdoor equipment enclosures be designed to effectively withstand these environmental elements so that the equipment enclosed therein is not damaged. To this end, the typical outdoor equipment enclosure consists of a steel box, or a box comprised of some other suitable material. Generally, the enclosure includes a door, and the door has a lock thereon which is meant to be unlocked only by an authorized serviceman. As mentioned, an outdoor equipment enclosure is typically subjected to environmental elements, and among the environmental elements to which it is generally subjected is heat from the sun. Because equipment enclosures are, in fact, enclosed and generally sealed, the inside of equipment enclosures have a tendency to reach extreme temperatures. Because it is important that the equipment contained within the equipment enclosure is not harmed by extreme temperatures, outdoor equipment enclosures are often supplied with an air conditioning unit therein.

Along with other equipment, the air conditioning unit is typically powered by a main power source. However, a secondary power source is often also provided in order to enable the air conditioning unit, and possibly other equipment, to be powered even when the main power source is shut down. Because the air conditioning unit and other connected equipment can be destroyed if simultaneously powered by both the main power source and the secondary source, it is very important to disable the main power source before activating the secondary power source. As a result, it is desirable to provide a device which allows the secondary power source to be activated if, but only if, the main power source is first de-activated.

OBJECTS AND SUMMARY

A general object of the present invention is to provide a device for preventing unwanted actuation of a switch.

An object of the present invention is to provide a mechanical interlock assembly for use within an electronics enclosure for preventing unwanted actuation of a switch therein.

Another object of the present invention is to provide a mechanical interlock assembly for use within an electronics enclosure for preventing simultaneous actuation of both a main breaker switch and a service breaker switch so that equipment, such as an air conditioning unit, is not harmed as a result.

A further object of the present invention to provide a mechanical interlock assembly for use within an electronics enclosure, where the mechanical interlock assembly is easy to operate.

A specific object of the present invention is to provide a mechanical interlock assembly for use within an electronics enclosure, where the mechanical interlock assembly comprises few parts and is easy to mount.

Briefly, and in accordance with the foregoing, the present invention envisions a mechanical interlock assembly for use within an electronics enclosure for preventing actuation of a service breaker switch when a main breaker switch is actuated. The mechanical interlock assembly comprises a bracket, an arm and a spring. The arm and spring are retained in a bracket which is mountable within the electronics enclosure adjacent the service breaker switch and the main breaker switch to selectively prevent unwanted actuation of the switches. The arm is slidable along a pin which extends between a a first and a second side wall of the bracket. The spring is retained along the pin between the arm and the first side wall of the bracket, and the spring loads a force between the arm and the first side wall of the bracket when the arm is displaced along the pin. The spring presses the arm against a toggle lever of the service breaker switch after the arm has been been displaced and the toggle lever of the service breaker switch has been actuated. The arm supporting panel of the bracket prevents the arm from rotating about the pin.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
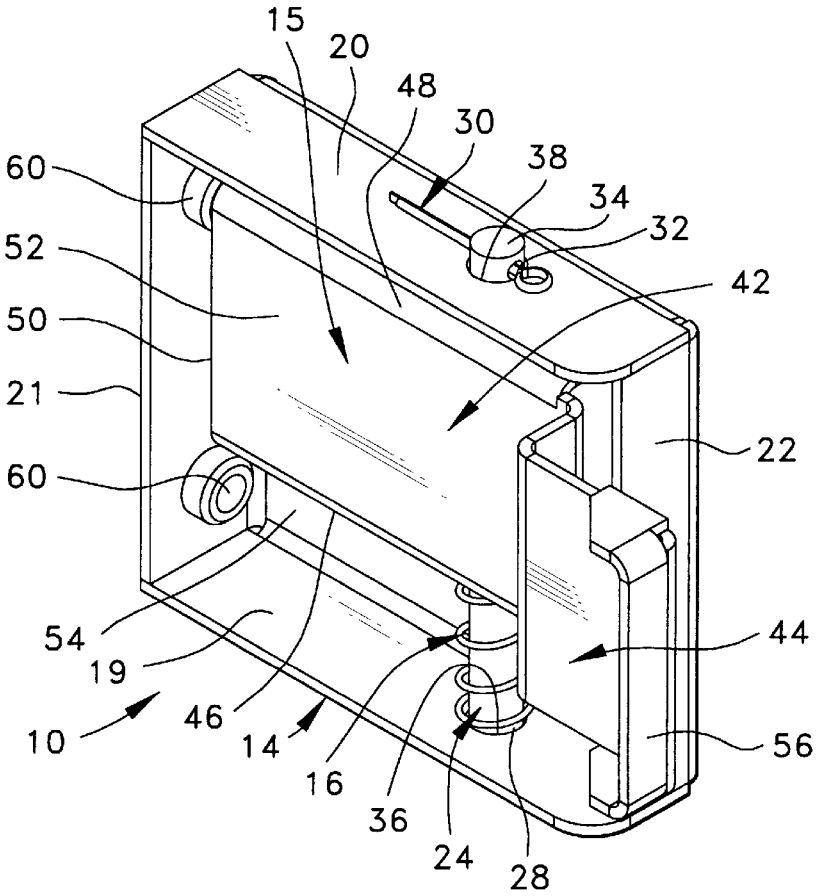
FIG. 1 is a perspective view of a mechanical interlock assembly in accordance with the present invention.
Figure 2:
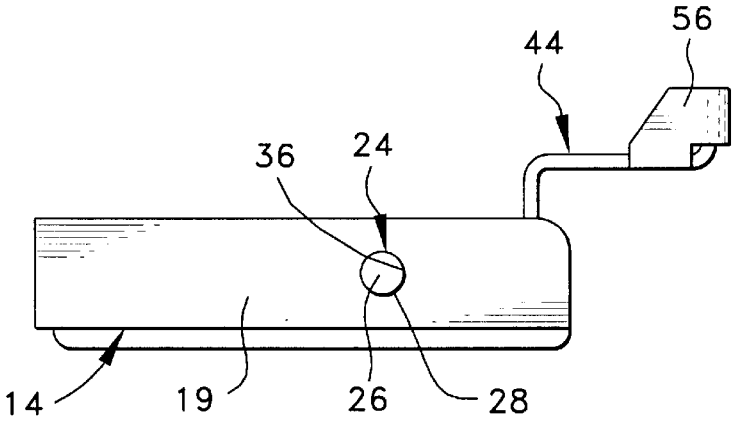
FIG. 2 is a bottom plan view of the mechanical interlock assembly shown in FIG. 1.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

A mechanical interlock assembly 10 is shown in the FIGURES. As shown in FIG. 1, the mechanical interlock assembly 10 comprises a bracket 14, an arm 15 and a spring 16. The arm 15 is biased by the spring 16, both of which are retained in the bracket 14, to prevent unwanted actuation of at least a pair of corresponding switches 17, 18. Selectively positioning the arm 15 in the path of a toggle lever 23, 25 of the switches 17, 18 prevents actuation of the switches 17, 18.

The bracket 14 has a first side wall 19 and a second side wall 20. The bracket 14 also preferably has a rear wall 21 and a front wall 22 connecting the side walls 19, 20 of the bracket 14. Extending between the first side wall 19 and the second side wall 20 is a pin 24, shown herein as a clevis pin. Of course, other forms of the pin 24 other than a clevis pin may be used. The pin 24 is retained on the bracket 14 by way of a retainer, such as a head 26 on a first end 28 of the pin 24 and a cotter pin 30 through a hole 32 in a second end 34 of the pin 24.

As shown, the first end 28 of the pin 24 extends through a hole 36 in the first side wall 19 of the bracket 14, and the head 26 on the first end 28 of the pin 24 is slightly larger than the hole 36 in the first side wall 19 of the bracket 14 so that the pin 24 cannot slide completely through the hole 36 in the side wall 19 of the bracket 14. The second end 34 of the pin 24 extends through a hole 38 in the second side wall 20 of the bracket 14, and the cotter pin 30 extends through the hole 32 in the pin 24 near the second end 34 of the pin 24. In this manner, the head 26 and the cotter pin 30 retain the pin 24 on the bracket 14. One skilled in the art would recognize other structures which can be used to perform essentially the same function as the head 26 and cotter pin 30.

As shown, an arm 15 of the mechanical interlock assembly 10 is located between the first side wall 19 and the second side wall 20 of the bracket 14. The arm 15 is comprised of a base 42 and an extending portion 44. The base 42 of the arm 15 may include side wall portions 46 and 48, as well as a rear wall portion 50 which is located adjacent the rear wall 21 of the bracket 14 and a front wall portion 52. The pin 24 extends through the side wall portions 46 and 48 of the base 42 of the arm 15, and the extending portion 44 of the arm 15 extends from the bracket 14. The bracket 14 includes a bottom wall 54 which is an arm supporting panel in that it generally prevents the arm 15 from rotating about the pin 24. One of ordinary skill in the art would recognize alternative means for preventing this rotation. To permit rotation of the arm 15 about the pin 24, the holes 36 and 38 can be provided as slots (not shown) so that the arm 15 can be pivoted across the pin 24 to permit the arm 15 to clear the bottom wall 54 and rotate about the pin 24.

Figure 5:
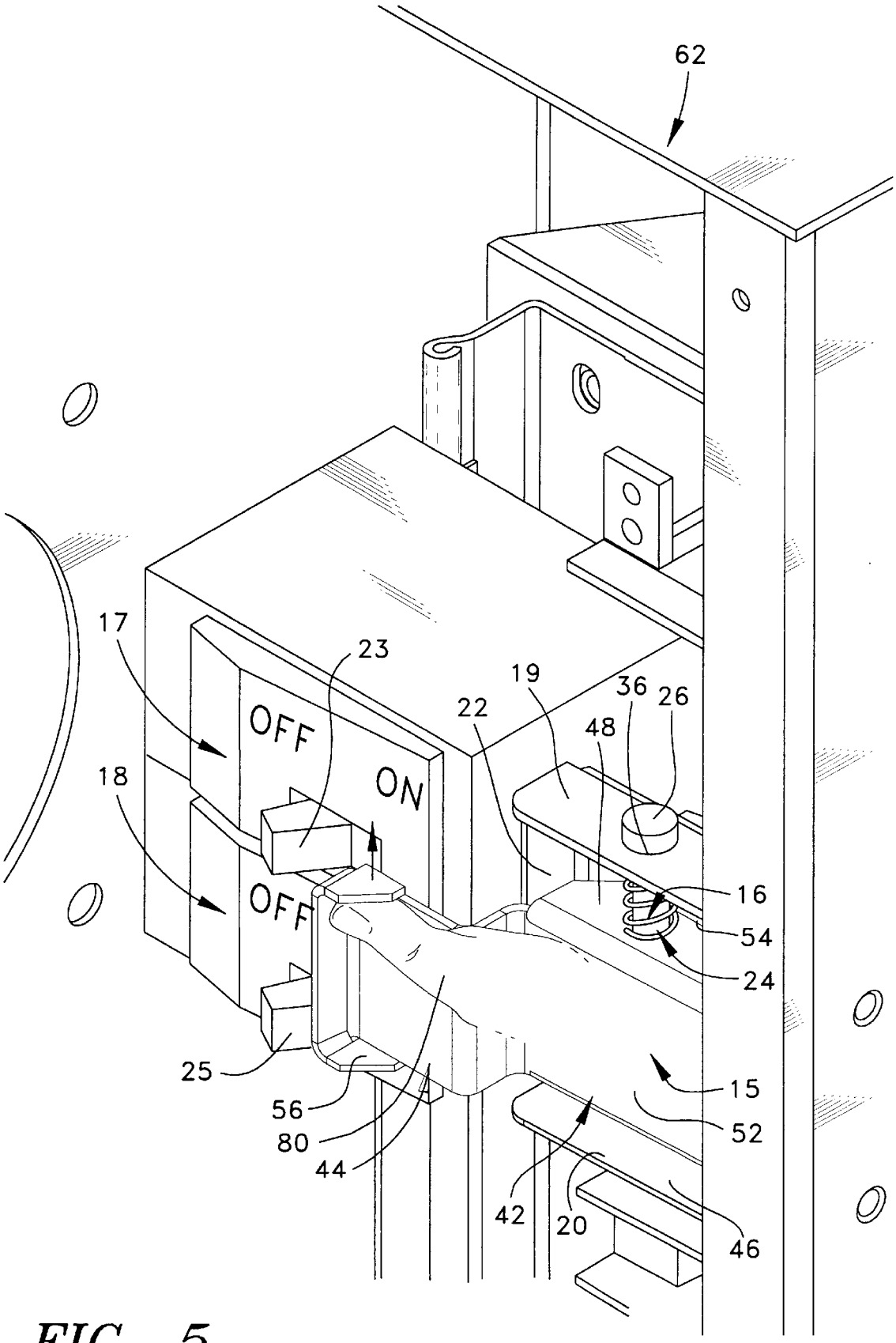
FIG. 5 is the mechanical interlock assembly and the electronics enclosure of FIGS. 3 and 4 showing the main breaker switch in its "off" position and an arm of the mechanical interlock assembly being moved upwardly toward the main breaker switch.
Figure 6:
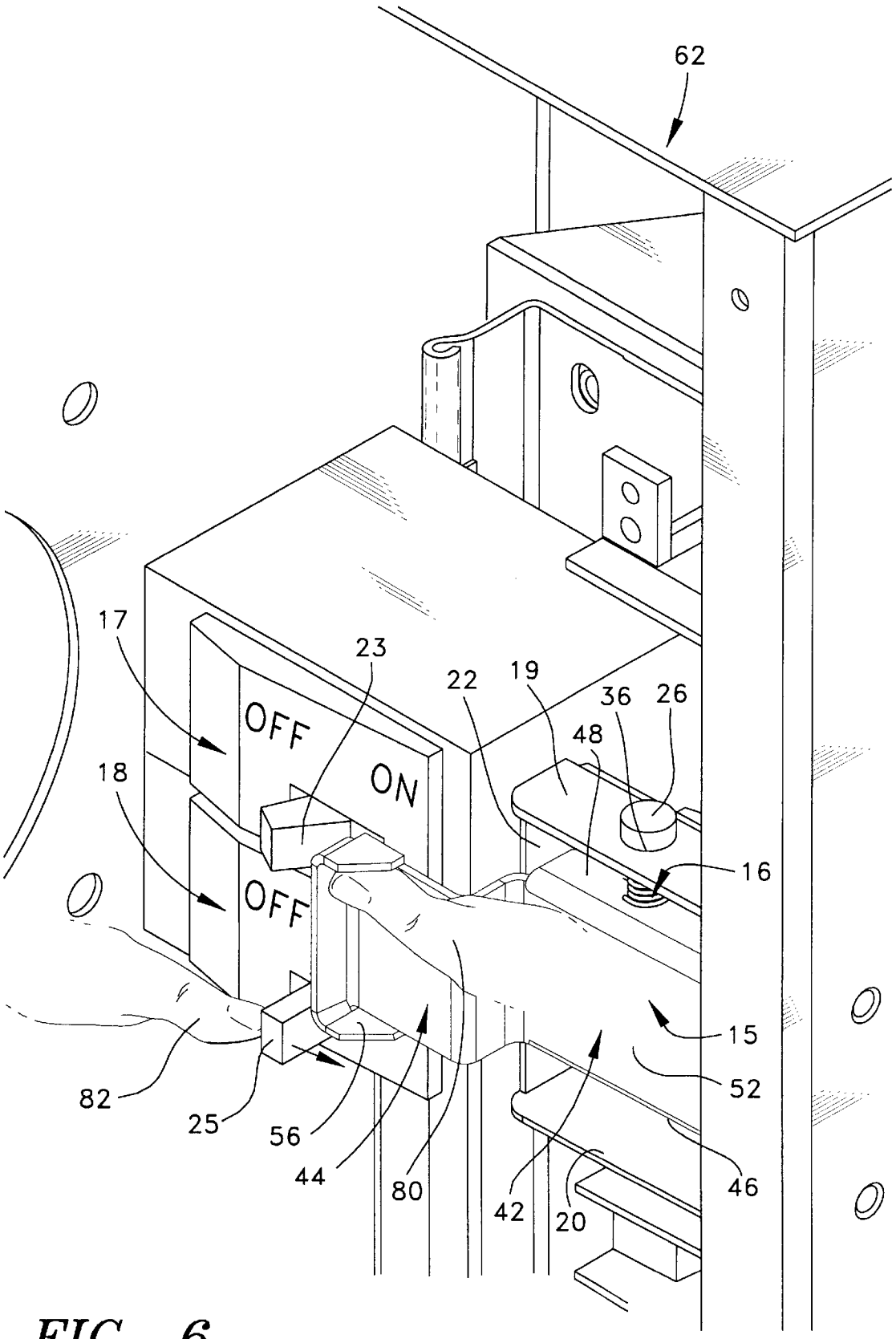
FIG. 6 is the mechanical interlock assembly and the electronics enclosure of FIGS. 3–5 showing the main breaker switch in its "off" position, the arm of the mechanical interlock assembly being held adjacent the main breaker switch, and a service breaker switch being switched to its "on" position.

A flange portion 56 may be provided on the extending portion 44 of the arm 15. Between the first side wall 19 of the bracket 14 and the side wall portion 46 of the arm 15 is the spring 16 in the form of a compression spring. The pin 24 extends through the compression spring 16. As shown in FIGS. 5 and 6, the compression spring 16 is capable of loading a force on the first side wall 19 of the bracket 14 and on the side wall portion 46 of the arm 15 when the arm 15 is moved or displaced along the pin 24. One of ordinary skill in the art, using the teachings provided herein, would realize that other structures may be used to perform essentially this same function (viz. supplying a force to the arm 15). For example, a different type of spring such as a tension spring could be utilized, or a combination of springs could be utilized.

As shown in FIG. 1, holes 60 are provided on the rear wall 21 of the bracket 14 to enable the mechanical interlock assembly 10 to be mounted in a securable manner. Of course, different structure may be utilized for mounting the mechanical interlock assembly 10 to a structure such as the cabinet for use with the switches 17, 18. Preferably, as shown in FIGS. 3–7, the mechanical interlock assembly 10 is mountable within an electronics enclosure 62. The operation of the mechanical interlock assembly 10 within an electronics enclosure 62 is described hereinbelow.

As mentioned, the mechanical interlock assembly 10 is preferably mountable within an electronics enclosure 62 as shown in FIGS. 3–7, and is mounted adjacent the main breaker switch 17 and the service breaker switch 18 within the electronics enclosure 62. The desirability of providing as such will now be described.

Figure 3:
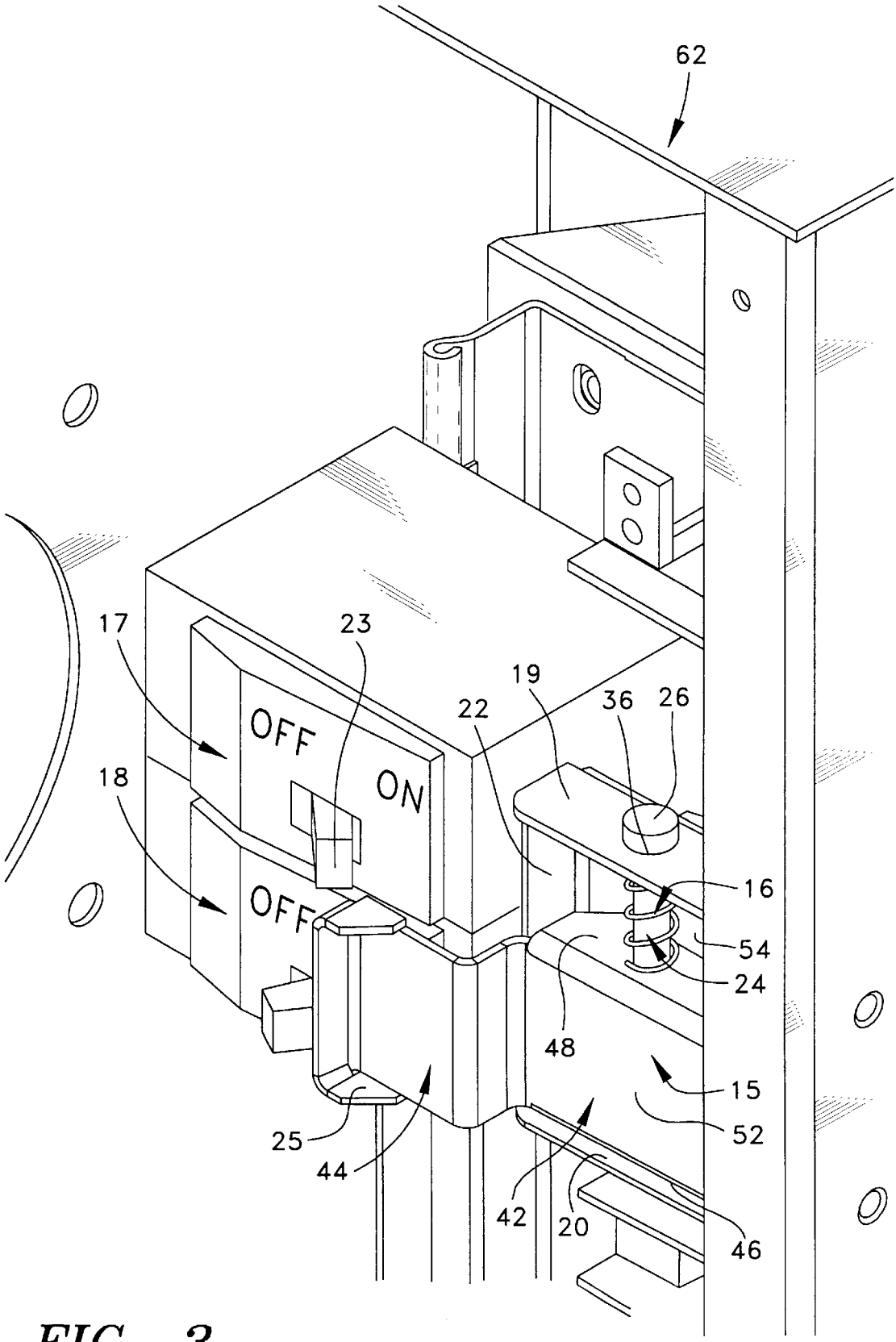
FIG. 3 shows the mechanical interlock assembly of FIGS. 1 and 2 mounted within an electronics enclosure with a main breaker switch in its "on" position.
Figure 7:
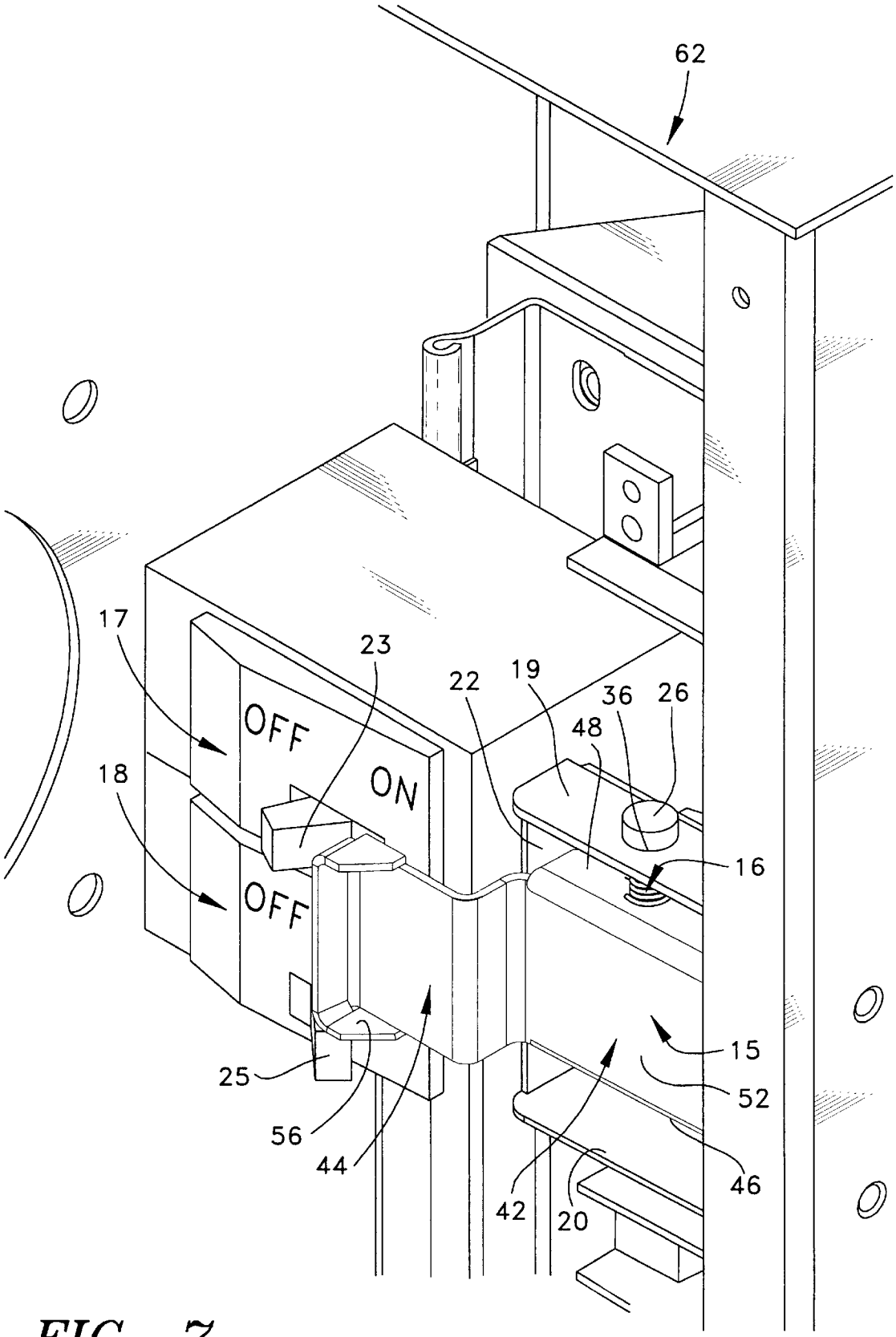
FIG. 7 is the mechanical interlock assembly and the electronics enclosure of FIGS. 3–6 showing the main breaker switch in its "off" position and showing the arm of the mechanical interlock assembly being held adjacent the main breaker switch by the service breaker switch which is in its "on" position.
Figure 8:
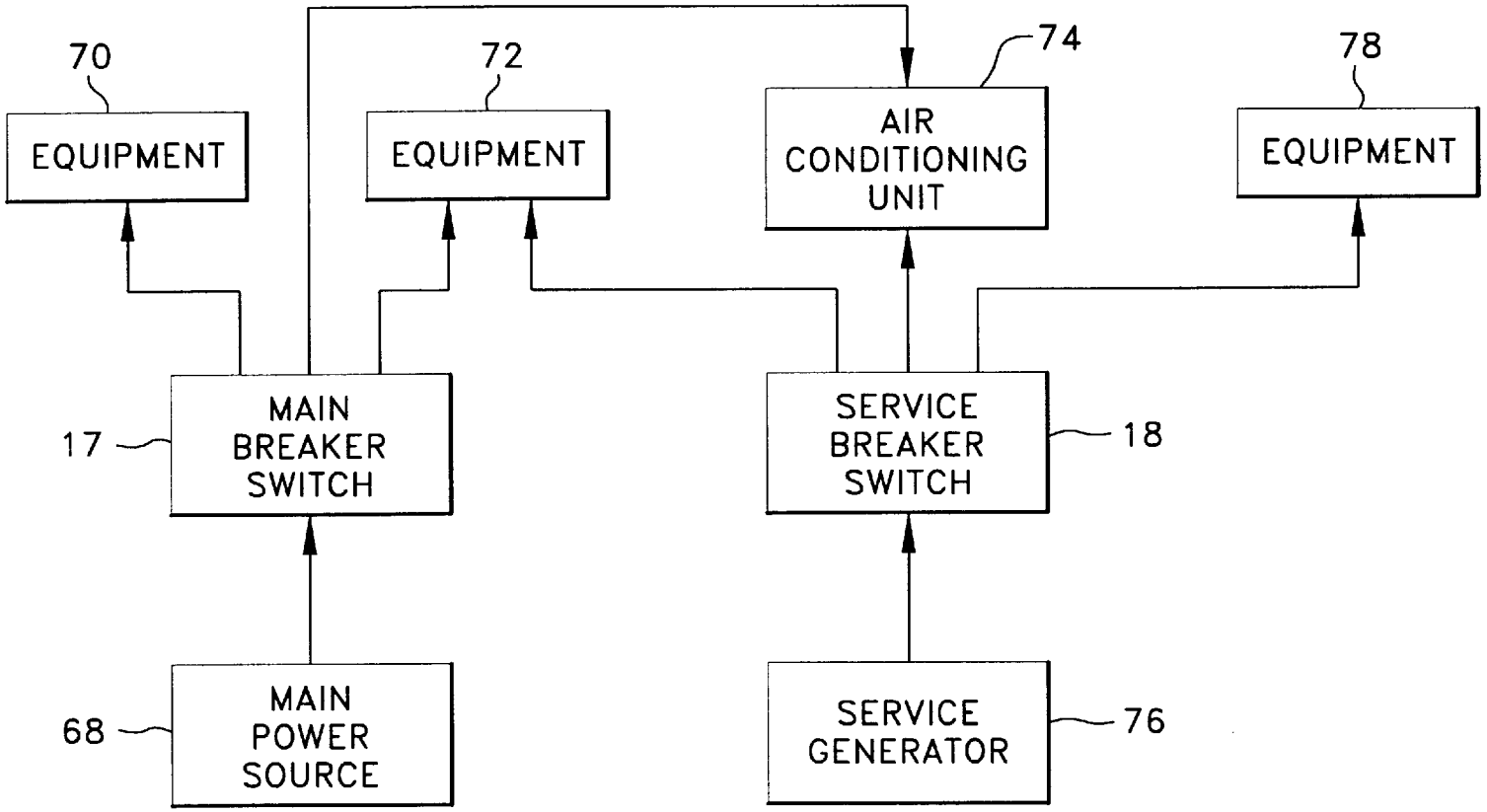
FIG. 8 is a schematic diagram showing connections to the main breaker switch and the service breaker switch of the electronics enclosure shown in FIGS. 3–7.

As shown in FIG. 8, the main breaker switch 17 of an electronics enclosure 62 may be connected to a main power source 68 and to equipment 70 and 72 as well as to an air conditioning unit 74. Additionally, the service breaker switch 18 of an electronics enclosure 62 may be connected to a service generator 76 and to equipment 72 and 78 as well as to the air conditioning unit 74. In this manner, the main power source 68 can power the equipment 70 and 72 and the air conditioning unit 74 if the main breaker switch 17 is in its "on" position as shown in FIG. 3. In contrast, the main power source 68 cannot power the equipment 70 and 72 and the air conditioning unit 74 if the main breaker switch 17 is in its "off" position as shown in FIGS. 4–7. In a similar manner, the service generator 76 can power the equipment 72 and 78 and the air conditioning unit 74 if the service breaker switch 18 is in its "on" position as shown in FIG. 7. In contrast, the service generator 76 cannot power the equipment 72 and 78 and the air conditioning unit 74 if the service breaker switch 18 is in its "off" position as shown in FIGS. 3–6.

Because providing power to the equipment 72 and the air conditioning unit 74 simultaneously from both the main power source 68 and service generator 76 may result in the equipment 72 and the air conditioning unit 74 becoming damaged, it is important to provide that the main breaker switch 17 and the service breaker switch 18 are never both in their "on" positions at the same time. Fortunately, use of the mechanical interlock assembly 10 as depicted and described herein prevents the main breaker switch 17 and the service breaker switch 18 of an electronics enclosure 62 from both being in their "on" positions at the same time. To this end, the mechanical interlock assembly 10 is mounted in the electronics enclosure 62 adjacent the main breaker switch 17 and the service breaker switch 18 as shown in FIGS. 3–7.

Normally, the main breaker switch 17 is in its "on" position and the service breaker switch 18 is positioned in its "off" position as shown in FIG. 3. At this time, the main power source 68, shown in FIG. 8, would power the equipment 70 and 72 and the air conditioning unit 74. However, in certain situations, it may be desired to keep the main power source 68 from providing power. For example, when the equipment 70 needs to be repaired, the main power source 68 must be disconnected from the equipment 70 before working on the equipment 70. Therefore, the main breaker switch 17 is switched to its "off" position as shown in FIG. 4 before working on the equipment 70.

Even though the power is disconnected from the equipment 70, one may want to maintain the power to the equipment 72 and to the air conditioning unit 74. To this end, one can switch the service breaker switch 18 to its "on" position to provide that the service generator 76 powers the equipment 72 and the air conditioning unit 74, as well as the equipment 78.

As mentioned, it is important that the main breaker switch 17 and the service breaker switch 18 never both be in their "on" positions at the same time. By providing the mechanical interlock assembly 10 mounted adjacent to the main breaker switch 17 and the service breaker switch 18 in the manner shown in FIG. 3, the toggle lever 25 of the service breaker switch 18 cannot be moved along its switch path or switched to its "on" position unless the arm 15 of the mechanical interlock assembly 10 is first moved out of the way of the toggle lever 25.

Figure 4:
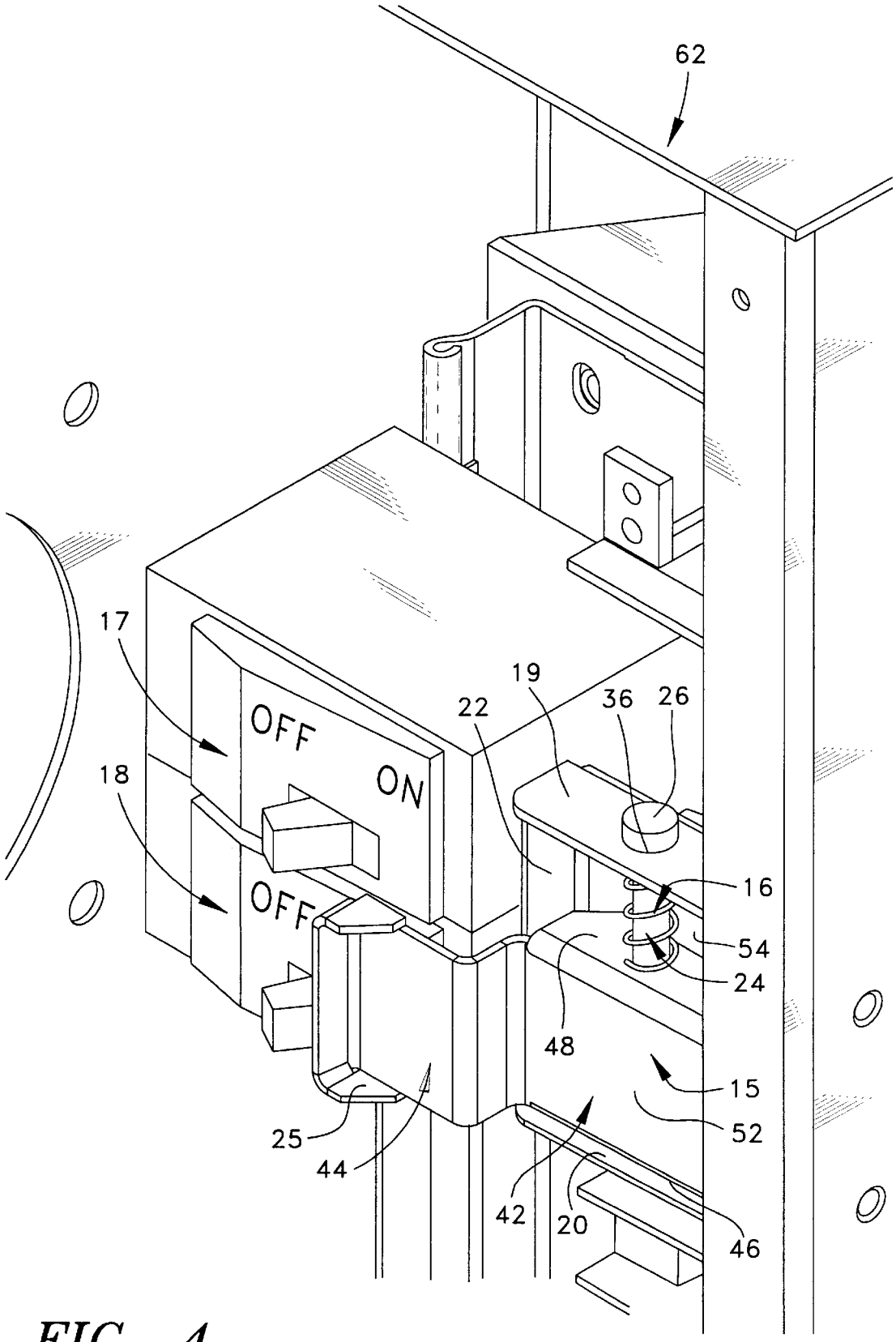
FIG. 4 is the mechanical interlock assembly and the electronics enclosure of FIG. 3 with the main breaker switch shown in its "off" position.

To this end, first the toggle lever 23 of the main breaker switch 17 must be moved from its "on" position, as shown in FIG. 3, to its "off" position, as shown in FIG. 4. Then, as shown in FIG. 5, one can apply a thumb 80 to the flange portion 56 on the extending portion 44 of the arm 15 in order to displace the arm 15 along the pin 24 and towards the first side wall 19 of the bracket 14. When the arm 15 is displaced along the pin 24, the arm 15 does not substantially rotate about the pin 24 because the bottom wall 54 of the bracket 14 prevents any substantial rotation. As the arm 15 is displaced along the pin 24, the compression spring 16 is compressed between the side wall portion 48 of the arm 15 and the second side wall 19 of the bracket 14.

The arm 15 is displaced along the pin 24 until the toggle lever 25 of the service breaker switch 18 can be moved to its "on" position using the other thumb 82. Thereafter, the service generator 76 will power the equipment 72 and the air conditioning unit 74 as well as the equipment 78. After the toggle lever 25 of the service breaker switch 18 is moved to its "on" position, the flange portion 56 of the extending portion 44 of the arm 15 may be released. When released, the spring 16 causes the extending portion 44 of the arm 15 to press against the service breaker switch 18 as shown in FIG. 7. The extending portion 44 of the arm 15 presses against the service breaker switch 18 because the compression spring 16 keeps pressing against the side wall portion 46 of the base portion 42 of the arm 15. Spring biased travel of the arm 15 along the pin 24 is prevented by the toggle lever 25 which blocks such movement of the arm 15.

Subsequent to the forgoing, turning the service breaker switch 18 "off" and turning the main breaker switch 17 back "on", requires pushing the extending portion 44 of the arm 15 towards the first side wall 19 of the bracket 14. Next, the toggle lever 25 of the service breaker switch 18 is moved to its "off" position. Then, the extending portion 44 of the arm 15 is released so that the compression spring 16 pushes the arm 15 substantially against the second side wall 20 of the bracket 14. Finally, the toggle lever 23 of the main breaker switch 17 is moved to its "on" position.

In this manner, the mechanical interlock assembly 10 according to the present invention can be used with an electronics enclosure 62 in order to prevent the main breaker switch 17 and the service breaker switch 18 from both simultaneously being in their "on", or activated, positions. As a result, equipment 72 and/or an air conditioning unit 74 is not damaged.

Of course, the mechanical interlock assembly 10 may be used in other applications and with other structures besides within an electronics enclosure 62. In fact, the mechanical interlock assembly 10 according to the present invention is useful in any application where it is necessary to selectively maintain two switches in selected positions. One of ordinary skill in the art would realize still other situations in which the mechanical interlock assembly 10 according to the present invention would be useful.

The entire mechanical interlock assembly 10 as shown is comprised of a metal, or some other suitable material. However, one skilled in the art would recognize that it is not imperative that the mechanical interlock assembly 10 be comprised of metal. In assembling the mechanical interlock assembly 10, the second end 34 of the pin 24, without the cotter pin 30 being in the hole 32, is pushed through the hole 36 in the first side wall 19 of the bracket 14 and towards the hole 38 in the second side wall 20 of the bracket 14. While the second end 34 of the pin 24 is being pushed through the hole 36, the arm 15 and the compression spring 16 are held between the first side wall 19 and the second sidewall 20 of the bracket 14. By holding the arm 15 and the compression spring 16 between the first side wall 19 and the second side wall 20 of the bracket 14 while the second end 34 of the pin 24 is pushed through the hole 36, the pin 24 is caused to travel through the side wall portions 46 and 48 of the arm 15 as well as through the compression spring 16. After the second end 34 of the pin 24 is pushed through the hole 36, through the side wall portions 46 and 48 of the arm 15, and through the compression spring 16, the pin 24 is further pushed towards the second side wall 20 of the bracket 14 such that the second end 34 of the pin 24 travels through the hole 38 in the second side wall 20 of the bracket 14. At this time, the cotter pin 30 is extended through the hole 32 in the pin 24. In this manner, the mechanical interlock assembly 10 can be easily and reliably assembled.

Therefore, while a preferred embodiment of the present invention is shown and described, it is envisioned that those skilled in the art may devise various modifications of the present invention without departing from the spirit and scope of the appended claims.

The invention claimed is:

1. A mechanical interlock assembly for preventing movement of a first switch when a second switch is in a first position and for preventing movement of the second switch when the first switch is in a first position, said mechanical interlock assembly comprising: a generally axially non-movable member; an arm displaceable along said generally axially non-movable member between a first location adjacent said first switch to prevent said first switch from being moved and a second location adjacent said second switch to prevent said second switch from being moved; and a force member on said generally axially non-movable member providing a force to said arm for directing said arm toward said first location; said generally axially non-movable member extending through said force member.

2. A mechanical interlock assembly as set forth in claim 1, wherein said force member comprises a spring.

3. A mechanical interlock assembly as set forth in claim 1, wherein said force member comprises a compression spring.

4. A mechanical interlock assembly as set forth in claim 2, further comprising a spring resisting wall, said spring located between said arm and said spring resisting wall, said spring resisting wall resisting said spring when said arm is moved toward said second location.

5. A mechanical interlock assembly as set forth in claim 4, said generally axially non-movable member comprising a pin, said pin axially extending from said spring resisting wall and carrying said spring and said arm.

6. A mechanical interlock assembly as set forth in claim 5, further comprising an arm supporting panel engageable with said arm to prevent said arm from rotating about said pin.

7. A mechanical interlock assembly as set forth in claim 1, wherein said arm is positioned against said first switch after said arm is displaced to said second location and said first switch is moved to said first position.

8. A mechanical interlock assembly as set forth in claim 4, wherein said spring is compressed between said arm and said spring resisting wall and compression forces of said spring position said arm against said first switch after said arm is displaced to said second location and said first switch is moved to said first position.

9. A mechanical interlock assembly for preventing movement of a first switch when a second switch is in a first position and for preventing movement of the second switch when the first switch is in a first position, said mechanical interlock assembly comprising: an arm displaceable between a first location adjacent said first switch to prevent said first switch from being moved and a second location adjacent said second switch to prevent said second switch from being moved; a spring resisting wall; a generally axially non-movable pin axially extending from said spring resisting wall and through said arm; a compression spring on said pin, said compression spring located between said arm and said spring resisting wall providing a force to said arm for directing said arm toward said first location, wherein said compression spring compresses between said arm and said spring resisting wall, wherein said arm is positioned against said first switch after said arm is displaced to said second location and said first switch is moved to said first position, and wherein said compression spring presses said arm against said first switch after said arm has been displaced to said second location and said first switch has been moved to said first position; an arm supporting panel engageable with said arm to prevent said arm from rotating about said pin; and a retainer holding said pin in place such that said pin is generally axially non-movable.

10. A mechanical interlock assembly for preventing movement of a first switch when a second switch is in a first position and for preventing movement of the second switch when the first switch is in a first position, said mechanical interlock assembly comprising: a bracket having a first side wall, a second side wall and an arm supporting panel; an arm; a generally axially non-movable pin axially extending between said first side wall and said second side wall of said bracket and through said arm, said arm slideable along said pin between a first location adjacent said first switch to prevent said first switch from being moved and a second location adjacent said second switch to prevent said second switch from being moved; and a spring on said pin, said spring located between said arm and said first side wall of said bracket and providing a force to said arm for directing said arm toward said first location, wherein said spring loads a force between said arm and said first side wall of said bracket when said arm is displaced toward said second location, wherein said spring presses said arm against said first switch after said arm is displaced to said second location and said first switch is moved to said first position, and wherein said arm supporting panel of said bracket is engageable with said arm to prevent said arm from rotating about said pin.

11. A mechanical interlock assembly as set forth in claim 10, wherein said bracket is mountable within an electronics enclosure, wherein said first switch comprises a service breaker switch connected to a service generator, wherein said second switch comprises a main breaker switch connected to a main power source, wherein movement of said service breaker switch to said first position turns on said service generator, and wherein movement of said main breaker switch to said first position turns on said main power source.

12. A mechanical interlock assembly as set forth in claim 11, wherein said service generator and said main power source power an air conditioning unit within said electronics enclosure.

13. A mechanical interlock assembly for use within an electronics enclosure for preventing actuation of a service breaker switch connected to a service generator when a main breaker switch connected to a main power source is in an actuated position and for preventing actuation of the main breaker switch when the service breaker switch is in the actuated position, said mechanical interlock assembly comprising: a bracket mountable within the electronics enclosure adjacent said service breaker switch and said main breaker switch, said bracket having a first side wall, a second side wall and an arm supporting panel; an arm; a generally axially non-movable pin axially extending between said first side wall and said second side wall of said bracket and through said arm, said arm displaceable along said pin between a first location adjacent said service breaker switch to prevent the service breaker switch from being actuated and a second location adjacent the main breaker switch to prevent the main breaker switch from being actuated; and a spring on said pin, said spring located between said arm and said first side wall of said bracket and providing a force to said arm for directing said arm toward said first location, wherein said spring loads a force between said arm and said first side wall of said bracket when said arm is displaced toward said second location, wherein said spring presses said arm against said service breaker switch after said arm is moved to said second location and said service breaker switch has been actuated, and wherein said arm supporting panel of said bracket is engageable with said arm to prevent said arm from rotating about said pin.

14. A mechanical interlock assembly as set forth in claim 13, wherein said service generator and said main power source power an air conditioning unit within the electronics enclosure.

* * * * *